US009333660B2

(12) United States Patent
Chen

(10) Patent No.: US 9,333,660 B2
(45) Date of Patent: May 10, 2016

(54) CURTAIN CUTTING AID

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 210 days.

(21) Appl. No.: 14/256,597

(22) Filed: Apr. 18, 2014

(65) Prior Publication Data

US 2015/0102546 A1 Apr. 16, 2015

(30) Foreign Application Priority Data

Oct. 11, 2013 (TW) ..... 102136870 A

(51) Int. Cl.
*B26D 7/00* (2006.01)
*B26B 29/06* (2006.01)

(52) U.S. Cl.
CPC ..... *B26B 29/06* (2013.01)

(58) Field of Classification Search
CPC ..... B26D 7/0006
USPC ..... 33/33; 269/229, 234, 236, 43, 45, 313, 269/314; 83/561, 648
See application file for complete search history.

(56) References Cited

U.S. PATENT DOCUMENTS 1,445,546 A * 2/1923 Olson ..... B25H 7/04 33/33
3,790,121 A * 2/1974 Sels ..... E04G 13/025 249/219.1
5,094,436 A * 3/1992 Stephan, III ..... B25B 1/08 269/153
5,408,909 A * 4/1995 Suk ..... B26D 1/045 83/467.1
5,443,339 A * 8/1995 Heredia ..... B23C 3/35 269/153
6,305,679 B1 * 10/2001 Brill ..... A63C 5/16 269/133
6,484,411 B1 * 11/2002 Nixon ..... E04F 21/1855 33/33
8,702,084 B2 * 4/2014 Doi ..... B28D 1/24 269/289 R
8,959,776 B2 * 2/2015 Shipp ..... B26B 29/063 269/289 R

* cited by examiner

*Primary Examiner* — Lee D Wilson
*Assistant Examiner* — Henry Hong
(74) *Attorney, Agent, or Firm* — Muncy, Geissler, Olds & Lowe, P.C.

(57) ABSTRACT

A curtain cutting aid includes a curtain holder including two hollow holder blocks arranged in parallel and defining therein a respective insertion space in communication with each other for a insertion of a curtain, a bearing plate connected between the two hollow holder blocks and a cutting groove defining between the two hollow holder blocks for the insertion of a cutter to cut off the inserted curtain, and a stop rod selectively and detachably mounted in the insertion space of one of the two hollow holder blocks to stop the inserted curtain in place for cutting. Thus, the curtain cutting aid can effectively enhance the convenience and precision of the cutting operation.

9 Claims, 7 Drawing Sheets

CURTAIN CUTTING AID

BACKGROUND OF THE INVENTION

1. Field of the Invention

The present invention relates to curtain cutting equipment, and more particularly to a curtain cutting aid.

2. Description of the Related Art

Commercial curtains are available in fixed sizes. Therefore, one curtain is suitable for one particular size of window. However, in recent years, in order to beautify the appearance of buildings, builders will usually design windows in special sizes, making the situation that curtains purchased from the market will not be applicable. At this time, custom made curtains are needed to fit these special window sizes. But this way will inevitably lead to increased costs.

For cost considerations, the current practice is to cut the curtain in accordance with the desired window size. However, if directly cutting the curtain without holding the curtain positively in position, a user or even a well-trained person cannot get a flat cut, and the overall appearance of the curtain can be damaged easily. Further, it is difficult to accurately control the cutting size in this cutting manner. Using a vise or other fixation tool to hold down the curtain in place for cutting can enhance the convenience of the cutting operation. However, applying an excessive clamping force to the curtain can cause deformation of the curtain. This will also cause a certain degree of impact on the overall appearance of the curtain.

SUMMARY OF THE INVENTION

The present invention has been accomplished under the circumstances in view. It is the main object of the present to provide a curtain cutting aid, which greatly enhances the convenience and precision of the cutting work, and effectively maintains the smoothness of the appearance of the curtain.

To achieve this and other objects of the present invention, a curtain cutting aid of the invention comprises a curtain holder and a stop rod. The curtain holder comprises two hollow holder blocks and a bearing plate. The two hollow holder blocks each define therein an insertion space. The two hollow holder blocks are arranged in parallel, keeping the insertion spaces thereof in communication with each other for the insertion of a curtain. Further, a cutting groove is defined between the two hollow holder blocks for the insertion of a cutter to cut off the insertion curtain. The bearing plate is connected between the two hollow holder blocks and facing toward the cutting groove for receiving the cutter. The stop rod is selectively and detachably mounted in the insertion space of one of the two hollow holder blocks to stop the inserted curtain in place for cutting.

Preferably, each hollow holder block of the curtain holder further comprises a plurality of through holes symmetrically disposed at two opposite sides thereof; the stop rod comprises at least one rod portion respectively and selectively inserted through the through holes of one hollow holder block and the insertion space of the respective hollow holder block to stop the inserted curtain positively in place.

Preferably, the curtain holder further comprises at least one positioning device mounted in one sidewall of one of the hollow holder blocks for holding down the inserted curtain in place for cutting in a stable manner.

Preferably, two guide devices are provided in one sidewall of each hollow holder block of the curtain holder at different elevations for guiding the insertion of the curtain into the curtain holder for cutting.

Other advantages and features of the present invention will be fully understood by reference to the following specification in conjunction with the accompanying drawings, in which like reference signs denote like components of structure.

DETAILED DESCRIPTION OF THE INVENTION

Figure 1:
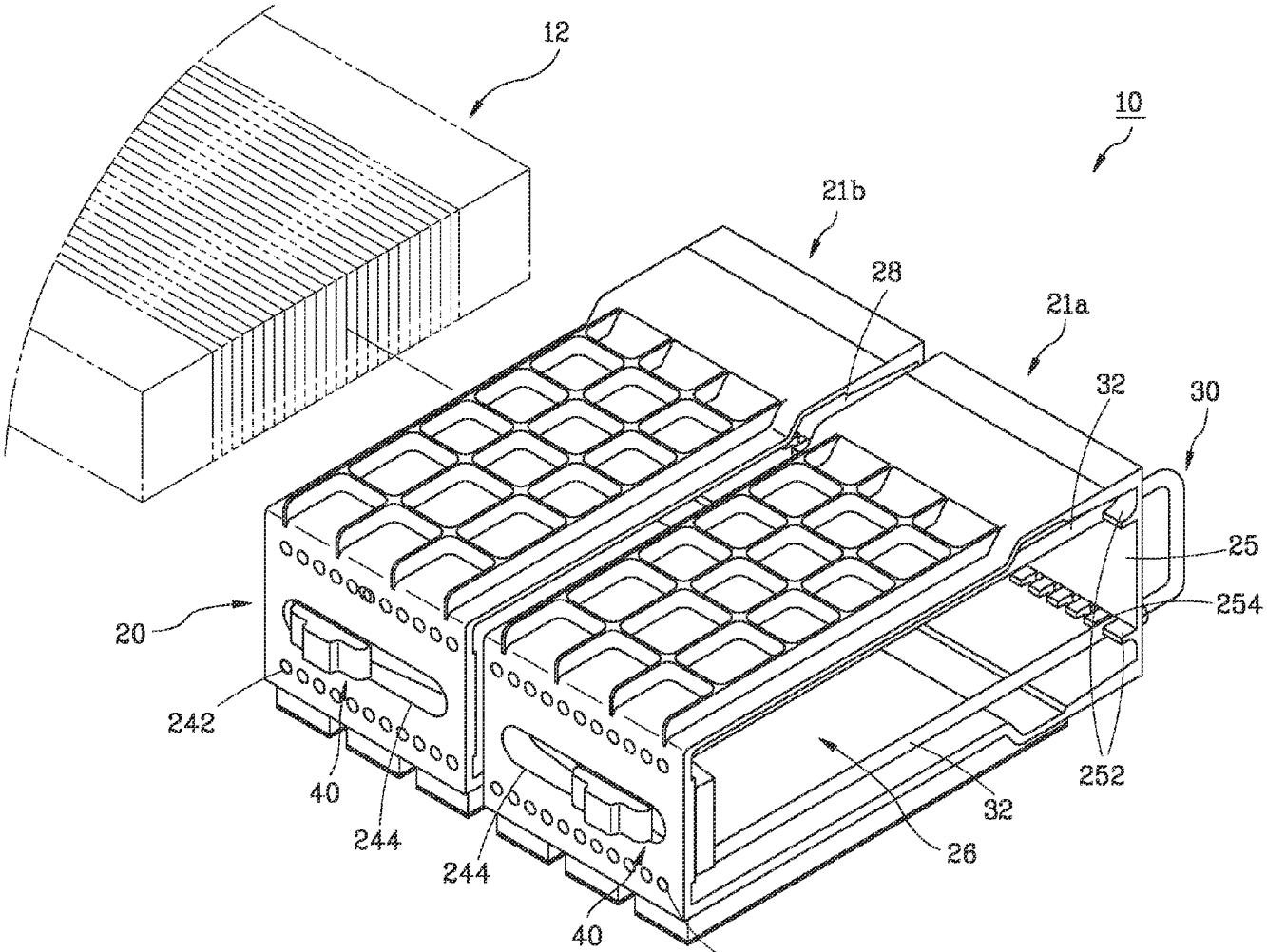
FIG. 1 is an oblique top elevational view of a curtain cutting aid in accordance with a first embodiment of the present invention.

Referring to FIG. 1, a curtain cutting aid 10 in accordance with the present invention is shown. As illustrated, the curtain cutting aid 10 comprises a curtain holder 20 and a stop rod 30.

Figure 2:
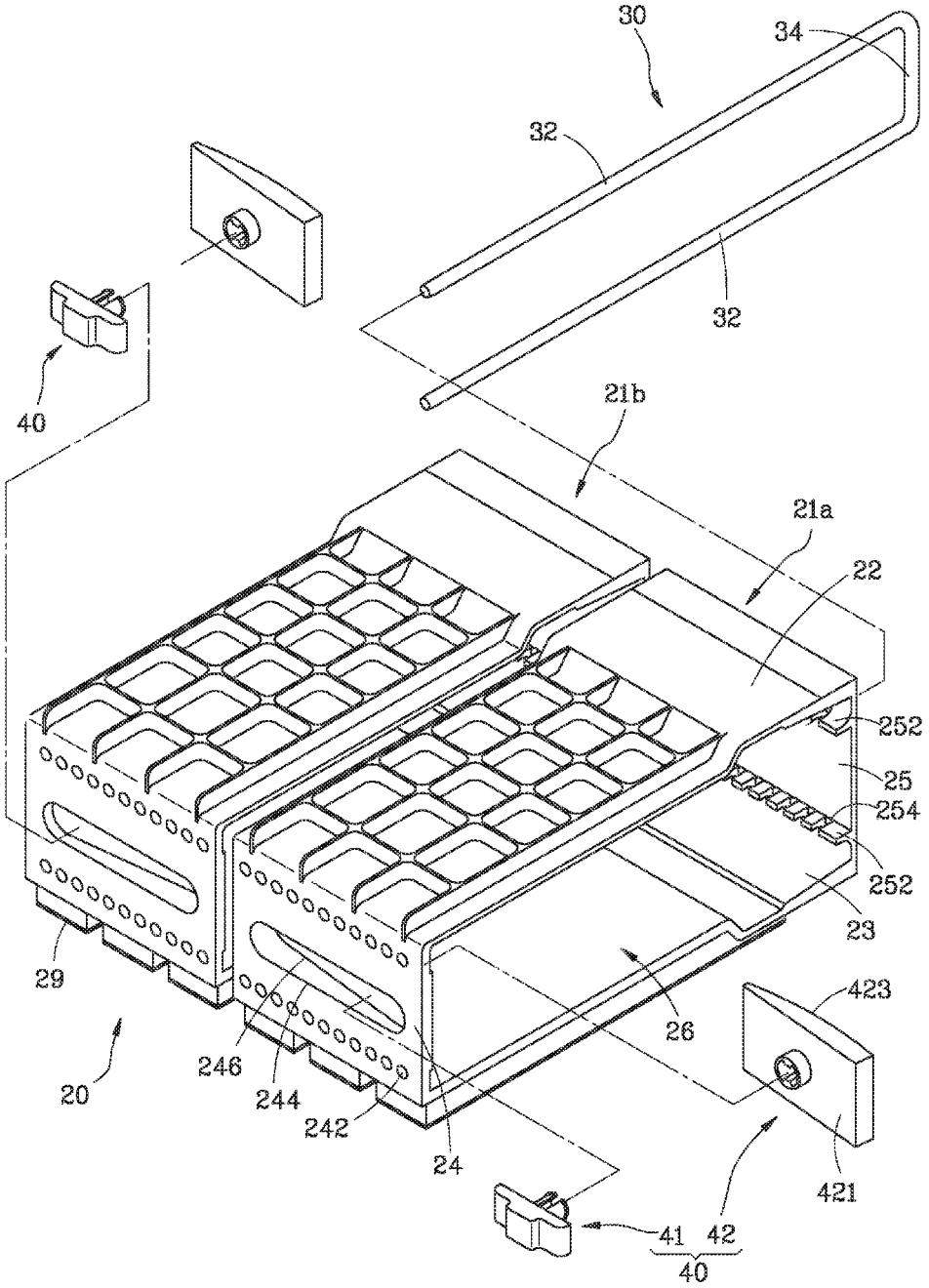
FIG. 2 is an exploded view of the curtain cutting aid in accordance with the first embodiment of the present invention.
Figure 3:
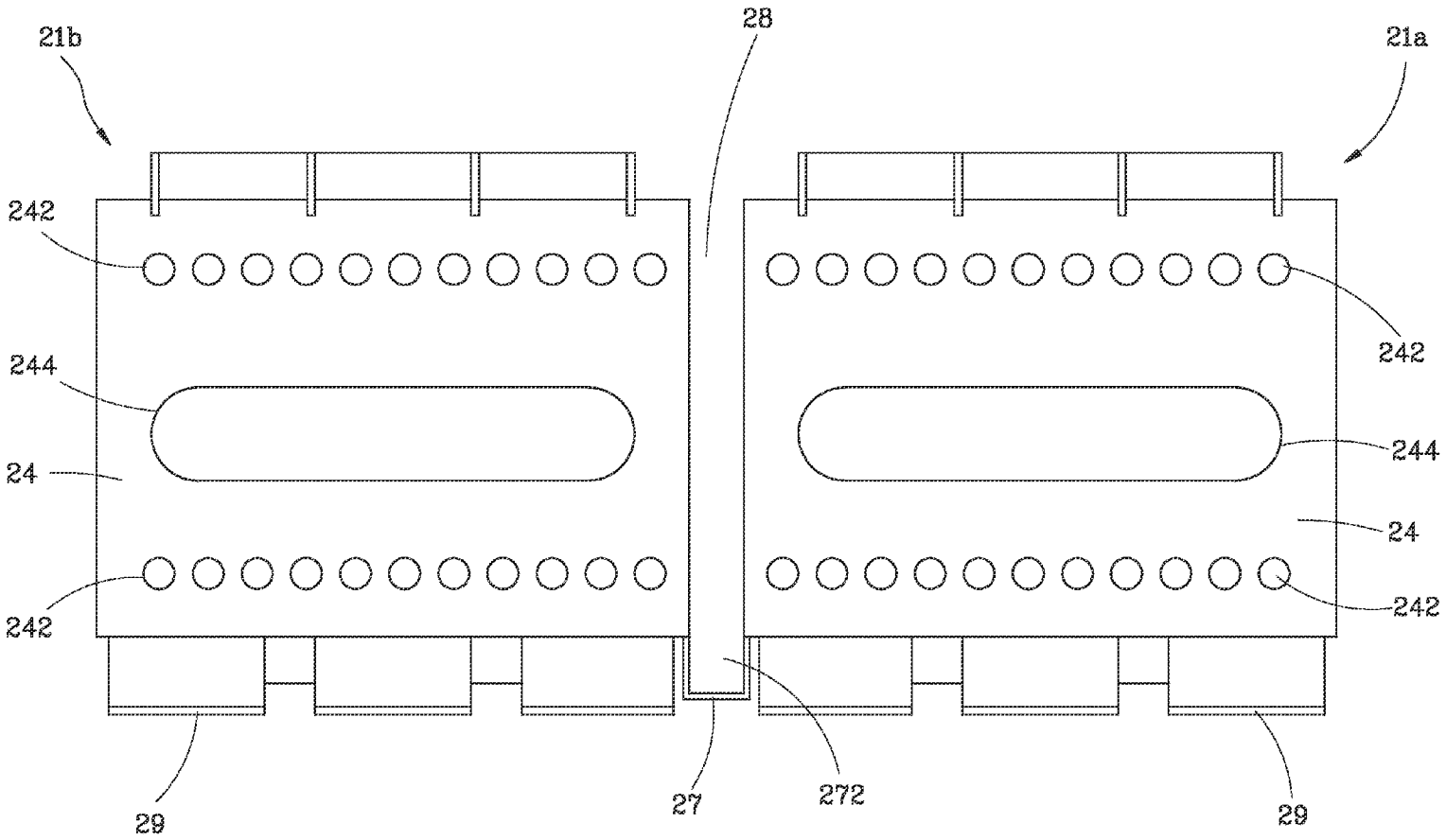
FIG. 3 is a side view of the curtain holder of the curtain cutting aid in accordance with the first embodiment of the present invention.

Referring also to FIGS. 2 and 3, the curtain holder 20 comprises two hollow holder blocks 21*a* and 21*b* arranged in parallel. Each hollow holder block 21*a* or 21*b* comprises a top wall 22, a bottom wall 23 opposite to the top wall 22, a first sidewall 24 connected between the top wall 22 and the bottom wall 23 at one side, and a second sidewall 25 connected between the top wall 22 and the bottom wall 23 opposite to the first sidewall 24. Thus, the top wall 22, bottom wall 23, first sidewall 24 and second sidewall 25 of each of the two hollow holder blocks 21*a* and 21*b* define an insertion space 26. The two hollow holder blocks 21*a* and 21*b* are arranged in parallel and disposed close to each other, and therefore the insertion spaces 26 of the two hollow holder blocks 21*a* and 21*b* are disposed in communication with each other for the insertion of a curtain 12. For guiding the curtain 12 into the insertion spaces 26 of the two hollow holder blocks 21*a* and 21*b* smoothly, two guide devices 252 are located at the second sidewall 25 of each of the two hollow holder blocks 21*a* and 21*b* at different elevations and projecting in direction toward the opposite first sidewall 24. Further, two rows of first through holes 242 are formed in the first sidewall 24 of each of the two hollow holder blocks 21*a* and 21*b* at different elevations; two rows of second through holes 254 are formed in the second sidewall 25 of each of the two hollow holder blocks 21*a* and 21*b* at different elevations and in a symmetrical manner relative to the two rows of first through holes 242.

Referring to FIG. 3 again, the curtain holder 20 further comprises a metal bearing plate 27 connected between the bottom walls 23 of the two hollow holder blocks 21*a* and 21*b*. Thus, a cutting groove 28 is defined between the two hollow holder blocks 21*a* and 21*b* for the insertion of a cutter (not shown) to cut the inserted curtain 12. Further, the bearing plate 27 defines therein a receiving groove 272 in communication with the cutting groove 28 for receiving the cutter that cut off the curtain 12.

The stop rod 30 comprises two rod portions 32 disposed in parallel, and a connection portion 34 connected between the two rod portions 32. During application, the stop rod 30 is fastened to one of the two hollow holder blocks 21*a* and 21*b* by inserting the two rod portions 32 through respective ones of two rows of second through holes 254 and the insertion space 26 into respective ones of the associating two rows of first through holes 242. After installation of the stop rod 30 in the hollow holder block 21*a* or 21*b*, the two rod portions 32 suspend between the first sidewall 24 and second sidewall 25 of the hollow holder block 21*a* or 21*b*, providing a stoppage effect.

Figure 4:
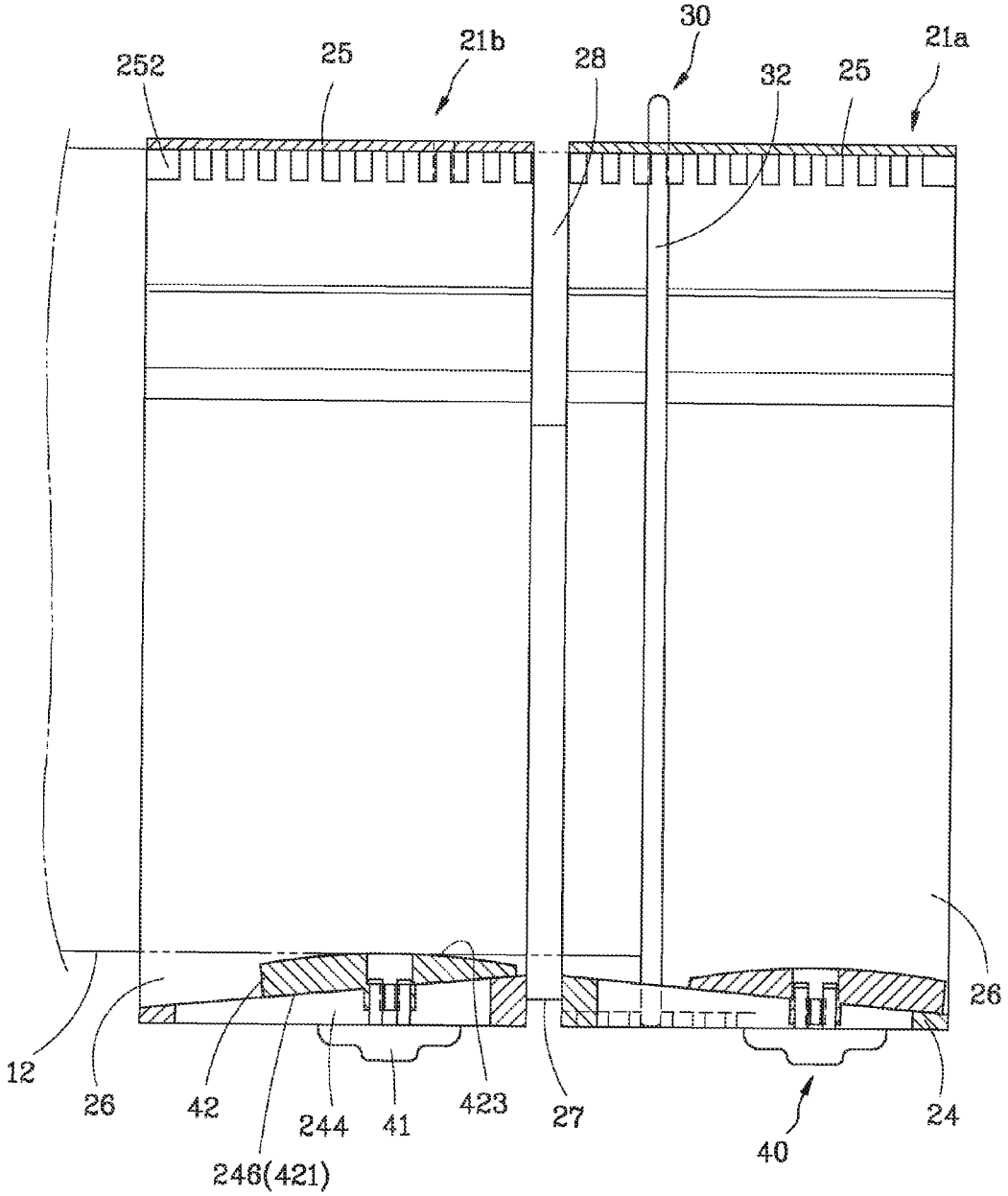
FIG. 4 is a sectional view of the curtain cutting aid in accordance with the first embodiment of the present invention.

In order to enhance the effect of keeping the curtain 12 in position, the first sidewall 24 of each of the two hollow holder blocks 21*a* and 21*b* of the curtain holder 20 is configured to provide an elongated slot 244 in communication with the insertion space 26 and a first sloping surface 246 facing toward the insertion space 26 (see FIG. 4). The curtain holder 20 further comprises two positioning devices 40 respectively mounted in the two hollow holder blocks 21*a* and 21*b*. Each positioning device 40 comprises an operating member 41 and a positioning plate 42. The operating member 41 is mounted in and movable along the elongated slot 244. The positioning plate 42 is connected to the operating member 41 and suspended in the insertion space 26. Further, the positioning plate 42 has a second sloping surface 421 located at one side thereof and abutted against the first sloping surface 246, and an arched positioning surface 423 located at an opposite side thereof.

When going to cut the curtain 12, as shown in FIGS. 1, 2 and 4, insert the two rod portions 32 of the stop rod 30 through selected first through holes 242 and second through holes 254 of the hollow holder block 21*a*, enabling the desired cutting length of the curtain 12 to be approximately equal to the distance between the cutting groove 28 and the rod portions 32 of the stop rod 30. Thereafter, insert one end of the curtain 12 along the two guide devices 252 of the hollow holder block 21*b* through the insertion space 26 of the hollow holder block 21*b* and the cutting groove 28 into the insertion space 26 of the hollow holder block 21*a* till that the curtain 12 is stopped against the rod portions 32 of the stop rod 30, and then, depending on the actual situation, operate the operating member 41 of one or each of the two positioning devices 40 to move the respective positioning plate 42 along the associating elongated slot 244 to adjust the position of the associating positioning plate 42. When moving the positioning plate 42, subject to mating between the first sloping surface 246 of the first sidewall 24 of the hollow holder block 21*b* and the second sloping surface 421 of the positioning plate 42, the arched positioning surface 423 of the positioning plate 42 can be tightly abutted against one lateral side of the curtain 12, holding the curtain 12 positively in position. At this time, a cutter (not shown) can be used and inserted into the cutting groove 28 to cut off the curtain 12. After cutting, release the positioning of the positioning plate 42 for allowing removal of the curtain 12 from the curtain holder 20, and then adjust the position of the stop rod 30 for allowing cutting of the other end of the curtain 12 to assure a symmetric outer appearance of the curtain 12. It's worth mentioning that, in order to prevent sliding of the curtain holder 20 when cutting the curtain 12, anti-slip pads 29 can be adhered to the bottom surface of the bottom walls 23 of the two hollow holder blocks 21*a* and 21*b* to provide the curtain holder 20 with an anti-slip effect.

Figure 5:
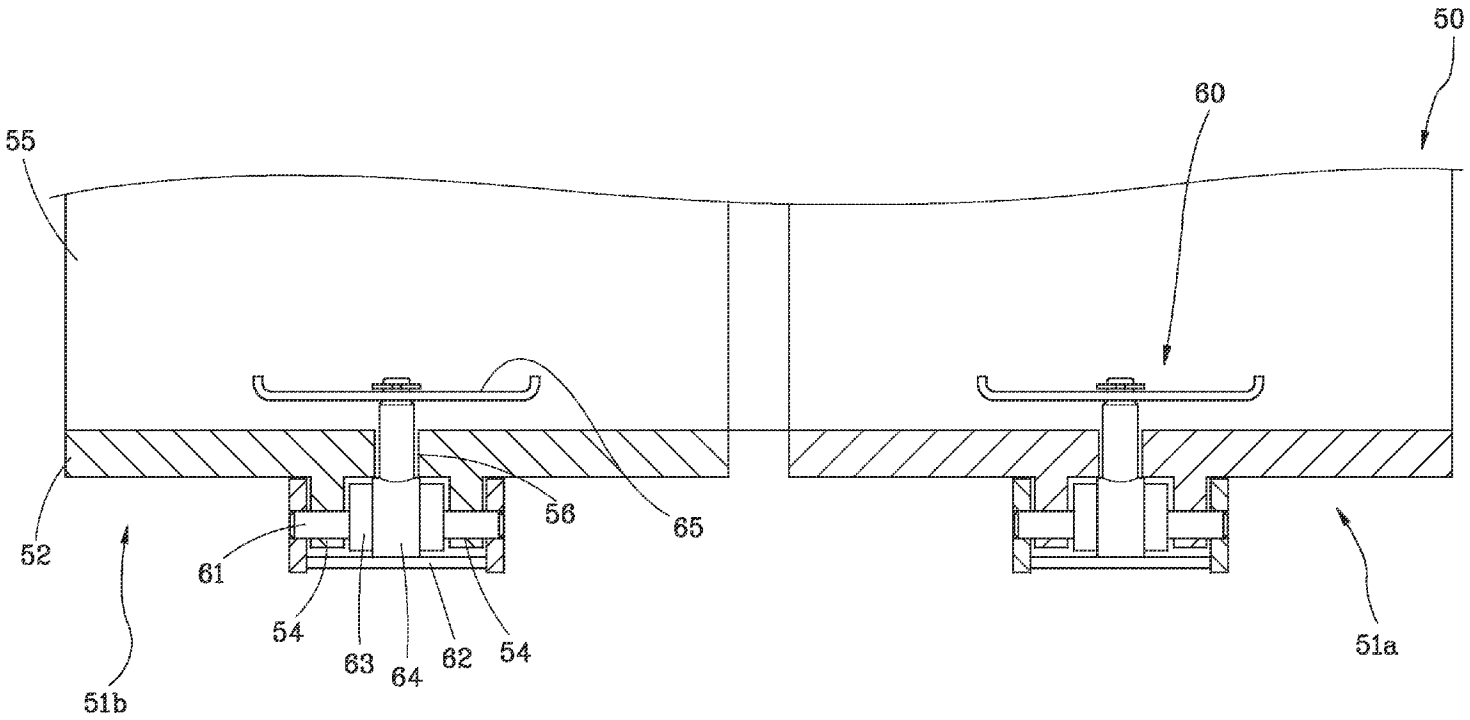
FIG. 5 is a sectional top view of a curtain cutting aid in accordance with a second embodiment of the present invention.
Figure 7:
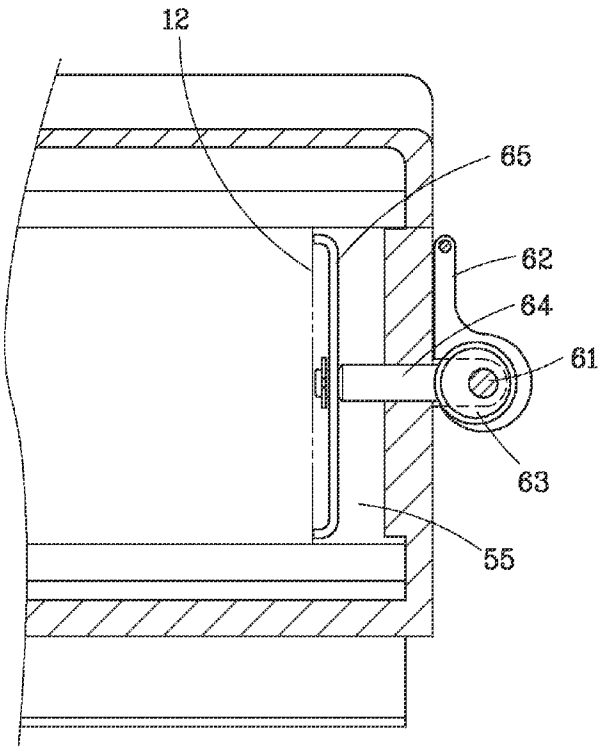
FIG. 7 is similar to FIG. 6, illustrating the handle moved up.
Figure 6:
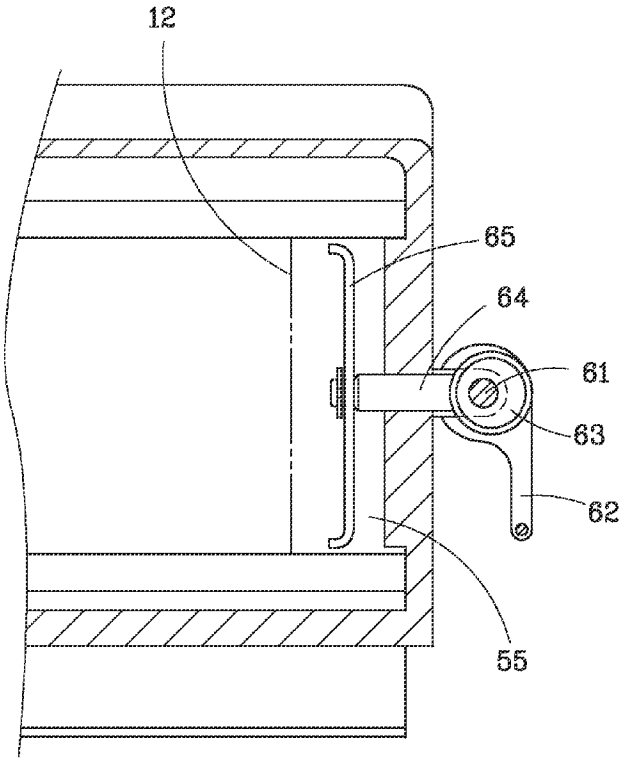
FIG. 6 is a sectional side view of the curtain cutting aid in accordance with the second embodiment of the present invention, illustrating the handle moved down.

Further, it is to be noted that the structure of the curtain holder can be modified to match with different positioning devices. In an alternate form of the curtain cutting aid shown in FIGS. 5-7, the first sidewall 52 of each of the two hollow holder blocks 51*a* and 51*b* of the curtain holder 50 is configured to provide two pivot lugs 54, and an axle hole 56 spaced between the two pivot lugs 54 in communication with the insertion space 55; the positioning device 60 comprises a pivot 61 rotatably coupled between the pivot lugs 54, a handle 62 connected to two opposite ends of the pivot 61, an eccentric cam 63 fixedly mounted around the pivot 61 between the two pivot lugs 54, a positioning plate 65 suspending in the insertion space 55, and a linking axle 64 that has one end thereof loosely coupled to the eccentric cam 63 and an opposite end thereof inserted through the axle hole 56 into the insertion space 55 and connected with the positioning plate 65. Thus, moving the handle 62 upward causes the pivot 61 to rotate the eccentric cam 63 synchronously, and the linking axle 64 will be forced forward subject to the eccentric relationship between the eccentric cam 63 and the pivot 61, forcing the positioning plate 65 into abutment against the curtain 12 tightly. On the contrary, when moving the handle 62 downward, the eccentric cam 63 will be driven by the handle 62 to move the linking axle 64 backward, releasing the positioning plate 65 from the curtain 12.

Figure 8:
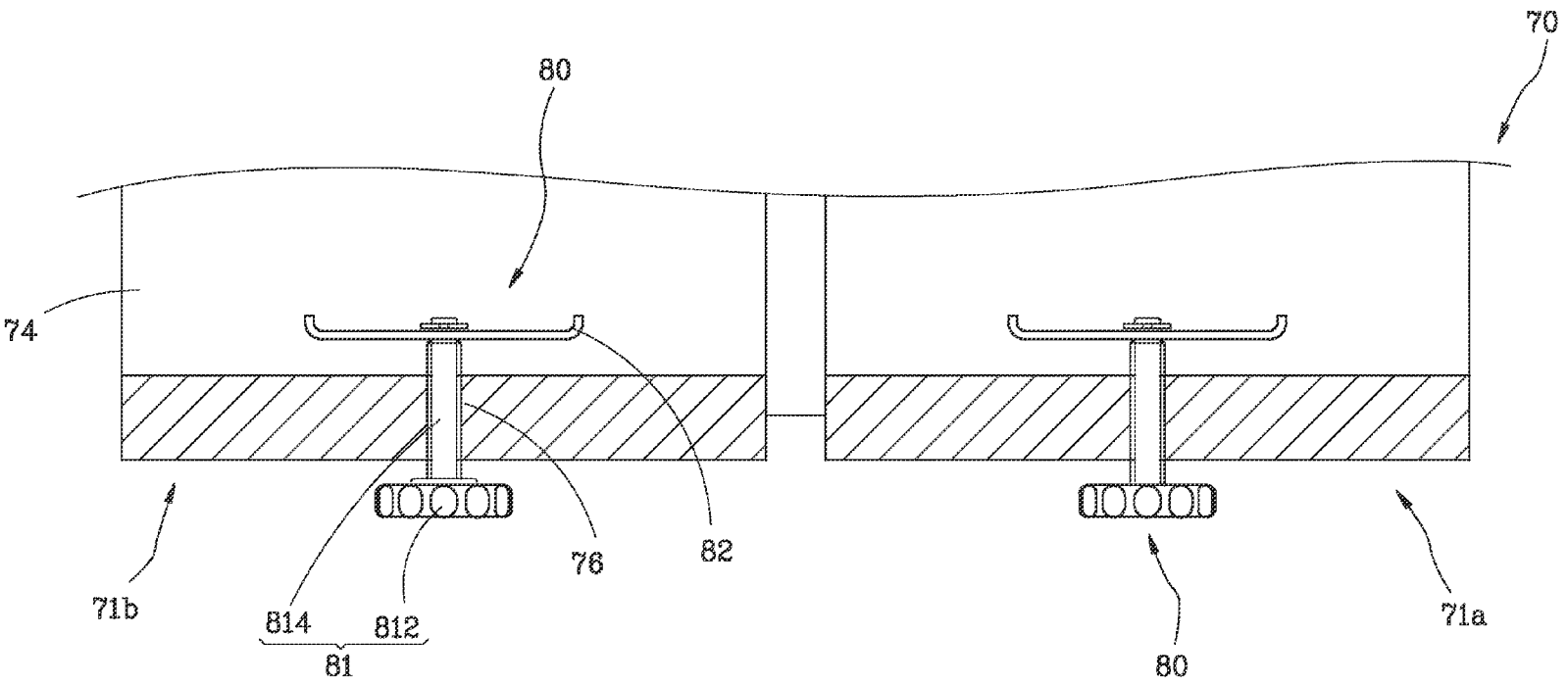
FIG. 8 is a sectional top view of a curtain cutting aid in accordance with a third embodiment of the present invention.

In another alternate form of the curtain cutting aid shown in FIG. 8, the first sidewall 72 of each of the two hollow holder blocks 71*a* and 71*b* of the curtain holder 70 is configured to provide a screw hole 76 in communication with the insertion space 74; the positioning device 80 comprises a torx screw 81 and a positioning plate 82. The torx screw 81 comprises a torx head 812 and a threaded shank 814. The threaded shank 814 is threaded into the screw hole 76, having its one end fixedly connected to the torx head 812 and its other end inserted into the inside of the insertion space 74 and connected with the positioning plate 82. Thus, rotating the torx screw 81 in one direction can force the positioning plate 82 to hold down the curtain 12. On the contrary, rotating the torx screw 81 in the other direction can release the positioning plate 82 from the curtain 12.

In conclusion, the curtain cutting aid 10 of the present invention can hold down the curtain 12 positively in position without damaging the structure of the curtain 12, allowing the user to cut off the curtain 12 easily and steadily, enhancing the convenience and precision of the cutting work and maintaining the smoothness of the appearance of the curtain.

What is claimed is:

1. A curtain cutting aid, comprising:

a curtain holder comprising two hollow holder blocks arranged in parallel, a cutting groove defined between said two hollow holder blocks and a bearing plate connected between said two hollow holder blocks and facing toward said cutting groove, each said hollow holder block defining therein an insertion space, the insertion spaces of said two hollow holder blocks being disposed in communication with each other; and a stop rod selectively and detachably mounted in the insertion space in one of said two hollow holder blocks;

wherein each said hollow holder block comprises a top wall, a bottom wall opposite to said top wall, a first sidewall connected between said top wall and said bottom wall at one side and a second sidewall connected between said top wall and said bottom wall at an opposite side relative to said first sidewall, said top wall, said bottom wall, said first sidewall and said second sidewall defining the insertion space of the respective said hollow holder block; said stop rod is selectively and detachably mounted between the first sidewall and second sidewall of one of said two hollow holder blocks.

2. The curtain cutting aid as claimed in claim 1, wherein each said hollow holder block of said curtain holder further comprises a plurality of first through holes located on the first sidewall thereof, and a plurality of second through holes located on the second sidewall thereof corresponding to said first through holes; said stop rod comprises at least one rod portion respectively and selectively inserted through one first through hole of one said hollow holder block and the insertion space of the respective said hollow holder block and one respective said second through hole of the respective said hollow holder block.

3. The curtain cutting aid as claimed in claim 2, wherein said first through holes and said second through holes of each said hollow holder block are respectively arranged in two rows at different elevations; said stop rod comprises two said rod portions disposed in parallel and respectively and selectively inserted through two said first through holes of one said hollow holder block and the insertion space of the respective said hollow holder block and two respective said second through holes of the respective said hollow holder block.

4. The curtain cutting aid as claimed in claim 1, wherein at least one of said two hollow holder blocks of said curtain holder comprises an elongated slot located on the first sidewall thereof in communication with the insertion space thereof and a first sloping surface located on the first sidewall thereof and facing toward the insertion space thereof; said curtain holder further comprises a positioning device mounted in at least one of said two hollow holder blocks, said positioning device comprising an operating member mounted in and movable along the elongated slot of the respective said hollow holder block and a positioning plate fixedly connected to said operating member and suspending in the insertion space of the respective said hollow holder block, said positioning plate comprising a second sloping surface located at one side thereof and abutted against the first sloping surface of the respective said hollow holder block and an arched positioning surface located at an opposite side thereof opposite to said second sloping surface.

5. The curtain cutting aid as claimed in claim 1, wherein at least one of said two hollow holder blocks of said curtain holder comprises a screw hole located on the first sidewall thereof in communication with the insertion space thereof; said curtain holder further comprises a positioning device mounted in at least one of said two hollow holder blocks, said positioning device comprising a torx screw and a positioning plate, said torx screw comprising a threaded shank threaded into said screw hole, said positioning device being connected with said torx screw and suspending in the insertion space of the respective said hollow holder block.

6. The curtain cutting aid as claimed in claim 1, wherein at least one of said two hollow holder blocks of said curtain holder comprises two pivot lugs located at the first sidewall thereof and an axle hole spaced between said two pivot lugs; said curtain holder further comprises a positioning device mounted in at least one of said two hollow holder blocks, said positioning device comprising a pivot, a handle, an eccentric cam, a linking axle and a positioning plate, said pivot being rotatably connected between said two pivot lugs, said handle being connected to said pivot, said eccentric cam being fixedly mounted around said pivot, said linking axle having one end thereof loosely coupled to said eccentric cam and an opposite end thereof inserted through said axle hole into said insertion space and connected with said positioning plate.

7. The curtain cutting aid as claimed in claim 1, wherein each said hollow holder block of said curtain holder further comprises at least one anti-slip pad mounted at the bottom wall thereof.

8. The curtain cutting aid as claimed in claim 1, wherein each said hollow holder block of said curtain holder further comprises two guide devices mounted at the second sidewall thereof at different elevations.

9. The curtain cutting aid as claimed in claim 1, wherein said bearing plate comprises a receiving groove disposed in communication with said cutting groove.

* * * * *